US011802382B2

(12) United States Patent
Losh

(10) Patent No.: US 11,802,382 B2
(45) Date of Patent: Oct. 31, 2023

(54) QUICK CURB BRACKET

(71) Applicant: Carrol Distributing & Construction Supply, Inc., Cicero, IN (US)

(72) Inventor: Dean Losh, Noblesville, IN (US)

(73) Assignee: Tuf-N-Lite, LLC, Liberty Township, OH (US)

( * ) Notice: Subject to any disclaimer, the term of this patent is extended or adjusted under 35 U.S.C. 154(b) by 286 days.

(21) Appl. No.: 17/038,984

(22) Filed: Sep. 30, 2020

(65) Prior Publication Data

US 2021/0095485 A1 Apr. 1, 2021

Related U.S. Application Data

(60) Provisional application No. 63/022,851, filed on May 11, 2020, provisional application No. 62/967,641, filed on Jan. 30, 2020, provisional application No. 62/945,515, filed on Dec. 9, 2019, provisional application No. 62/934,610, filed on Nov. 13, 2019, provisional application No. 62/907,809, filed on Sep. 30, 2019.

(51) Int. Cl.

| | |
|---|---|
| ***E01C 19/50*** | (2006.01) |
| ***E04G 17/14*** | (2006.01) |
| *E04G 13/06* | (2006.01) |

(52) U.S. Cl.

CPC ..... *E01C 19/506* (2013.01); *E04G 17/14* (2013.01); *E04G 13/062* (2013.01)

(58) Field of Classification Search

CPC ..... E04G 17/14; E04G 13/062; E01C 19/50; E01C 19/502; E01C 19/506

See application file for complete search history.

(56) References Cited

U.S. PATENT DOCUMENTS

| | | | | | |
|---|---|---|---|---|---|
| 1,628,316 | A * | 5/1927 | Heltzel | E01C 19/506 | 249/219.1 |
| 1,672,760 | A * | 6/1928 | Heltzel | E01C 19/502 | 249/208 |
| 2,894,310 | A * | 7/1959 | Hogan | E01C 19/506 | 249/208 |
| 5,156,753 | A * | 10/1992 | Speidel | E01C 19/506 | 249/219.1 |
| 7,182,309 | B1 * | 2/2007 | Olsen | E04G 17/12 | 269/37 |
| 2004/0144053 | A1 * | 7/2004 | Jenkins | E01C 19/506 | 52/584.1 |
| 2008/0118308 | A1 * | 5/2008 | Jones | E01C 19/506 | 404/98 |

(Continued)

FOREIGN PATENT DOCUMENTS

| | | | | |
|---|---|---|---|---|
| CN | 106193582 A * | 12/2016 | E04G 13/062 | |
| CN | 106884532 A * | 6/2017 | E04G 13/062 | |
| CN | 108203912 A * | 6/2018 | E01C 19/502 | |

(Continued)

*Primary Examiner* — Michael Safavi

(74) *Attorney, Agent, or Firm* — Overhauser Law Offices, LLC

(57) ABSTRACT

A concrete form bracket for holding in place concrete forms. The bracket may have horizontally extendable arms with pivotable concrete form engaging surfaces. One or more of the horizontally extending arms pivot from a central area and are independently extendable/adjustable to engage a concrete form at multiple locations.

14 Claims, 19 Drawing Sheets

(56) References Cited

U.S. PATENT DOCUMENTS

2016/0199998 A1* 7/2016 Daul ..... E01C 19/4886
249/2

FOREIGN PATENT DOCUMENTS

| | | | | | |
|---|---|---|---|---|---|
| CN | 108775147 | A | * | 11/2018 | ..... E04G 11/06 |
| CN | 109137665 | A | * | 1/2019 | ..... E04G 17/14 |
| CN | 109403189 | A | * | 3/2019 | ..... E01C 19/502 |
| CN | 111979882 | A | * | 11/2020 | ..... E01C 19/50 |
| CN | 113322756 | A | * | 8/2021 | ..... E01C 19/502 |
| CN | 113774763 | A | * | 12/2021 | ..... E01C 19/502 |
| CN | 114033197 | A | * | 2/2022 | ..... E04G 25/065 |
| DE | 102008046476 | A1 | * | 3/2010 | ..... E01C 19/506 |
| KR | 100883385 | B1 | * | 2/2009 | ..... E01C 19/506 |
| WO | WO-2017174725 | A1 | * | 10/2017 | ..... E04G 17/14 |

* cited by examiner

QUICK CURB BRACKET

CROSS REFERENCE TO RELATED APPLICATIONS

This application claims the benefit of US Provisional Application Nos. 62/907,809 filed Sep. 30, 2019, 62/934,610 filed Nov. 13, 2019, 62/945,515 filed Dec. 9, 2019, 62/967,641 filed Jan. 30, 2020, and 63/022,851 filed May 11, 2020.

FIELD OF THE INVENTION

The present invention relates to brackets used to hold forms that define the side edges of where concrete is to be poured.

BACKGROUND

The present disclosure relates to systems for holding in place forms that define the exterior edges of, and hold, poured concrete, including concrete structures that engage the ground. Examples include concrete slabs, walls or curbs. The forms remain in place until the concrete cures, and are then removed.

Typically, a form is made from either bendable plastic, lumber ranging in width from a 2×6 to a 2×12, or plywood. For curved structures such as curbs or curved walls, bendable plastic or plywood are the preferred materials for creating forms, as they are more flexible than lumber. The edges of the finished concrete are usually vertical, although they may be near vertical for some structures like curbs.

The forms are typically held in place by stakes driven into the ground to abut the form approximately every 12 inches. Alternatively, concrete form brackets may be used that comprise one or more vertically-spaced and extendable arms that are held together by a vertical connecting member. The form bracket is affixed to the ground by pins, stakes, or screws. The extendable arms are then extended or adjusted to engage the concrete form. The ends of the extendable arms typically include a concrete form engaging surface, such as a small plate with a rigid vertical surface.

When such form brackets or stakes are used, they must be spaced about one to two feet apart along the surface of the concrete form.

Existing concrete form brackets have multiple disadvantages. The concrete form engaging surfaces are rigid, having a face that is perpendicular or near-perpendicular to the ground. This can be acceptable if the edge of the desired concrete structure is flat and perfectly vertical, such as the edge of a slab. However, if the edge of the desired concrete surface is curved (whether convex or concave), or not vertical, such as for a curb having a taper, then the rigid, perpendicular orientation of the concrete form engaging surface is suboptimal. In that case, only one edge of the surface would abut the concrete form, as opposed to the entire face of the engaging surface.

A second problem with existing concrete form brackets is that one is required for each position along the concrete form where support for the form must be provided. Instead, it would be desirable to provide a single bracket that could support a concrete form at multiple horizontal points.

SUMMARY OF THE INVENTION

Disclosed is a concrete form bracket for holding in place concrete forms. In one embodiment, the bracket has an extendable arm with a concrete form engaging surface, in which the face of the surface is pivotable. This allows the face of the engaging surface to fully abut the concrete form, which helps to apply more pressure to the form. In another embodiment, a bracket includes multiple arms. While one arm may optionally be fixed, the remaining arms, or all the arms, pivot from a central area and are independently extendable/adjustable. Thus, the arms of a single bracket can be spread out to engage a concrete form at multiple locations.

Many contractors that pour concrete use Symons panels as their concrete form. Disclosed is a u-shaped pocket bracket that allows the use of the concrete form bracket with the Symons panels without screwing in to the Symons panels. This is desirable because Symons panels may be rented and then any holes made during use must be repaired prior to returning. The pocket bracket screws into a 2×4 and has a tab that is inserted between a joint in the Symons panels.

Further disclosed is an isolation form for a concrete slab with sliding connectors. When pouring concrete, there are times in which it is ideal to be able to leave an empty space that is not filled. The isolation form is placed where the contractor does not want the concrete to be poured. The concrete can then be poured around the isolation form leaving the interior of the form free of concrete.

DETAILED DESCRIPTION

Figure 1:
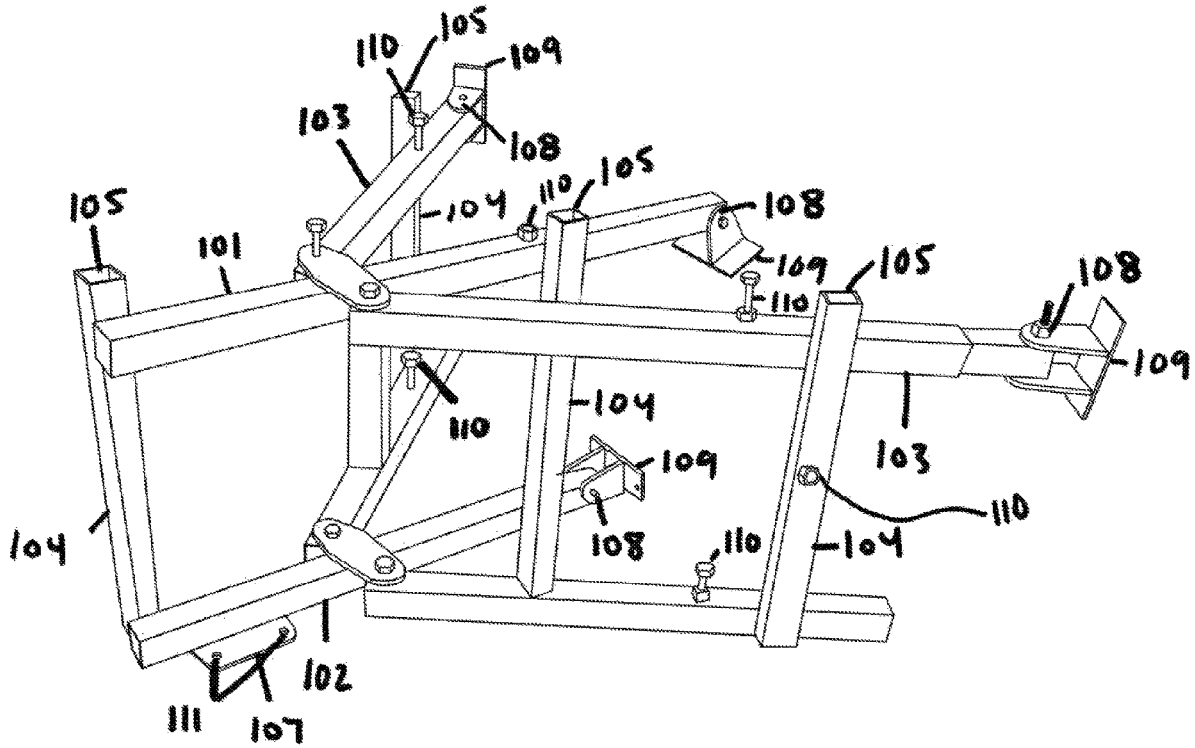
FIG. 1 is a side/rear perspective view of a bracket with two pivotable sets of arms.
Figure 10:
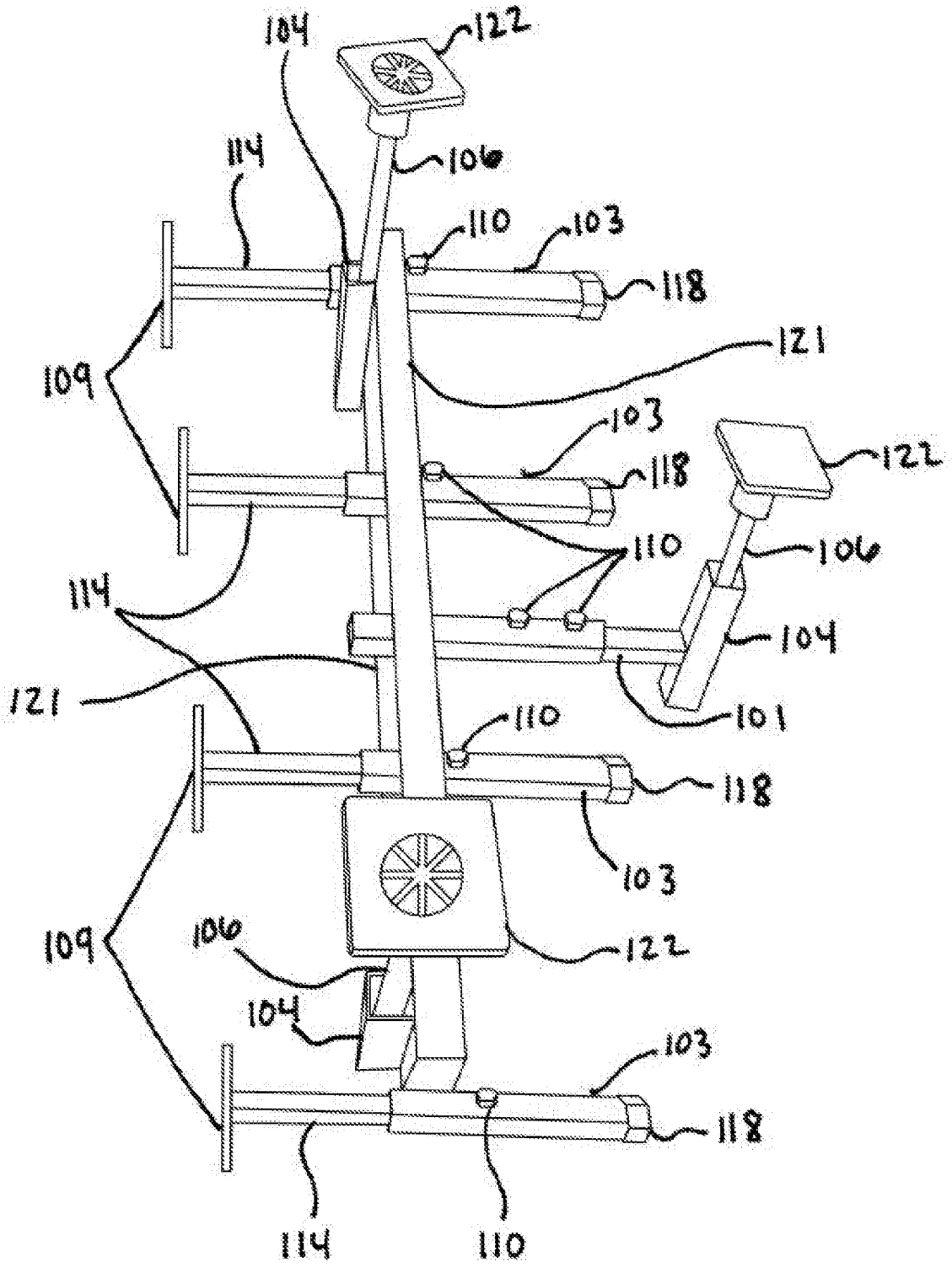
FIG. 10 shows a version of the bracket with rubber caps on stakes used to hold the bracket in place.

FIG. 1 is a side/rear perspective view of a bracket with first and second fixed central arms 101 and 102 and two sets of extendable horizontal pivotable arms 103. The bracket may also have a third fixed central arm 113 as shown in FIG. 4. The vertical members 104 and arms 101,102, and 103 may be formed from steel stock that is about 1.5" square in cross-section and that has a central cavity. Further as shown in FIG. 1, there is a vertically extending arm 104 that has a means for affixing the support bracket to the ground 105. In the version shown in FIG. 1, the means for affixing the support bracket to the ground comprises the hollow interior 105 of the vertically extending arm 104. This affixes the support bracket to the ground by allowing the vertically extending arm 104 to receive a stake 106 as shown in FIG. 10. An alternative means for affixing the support bracket to the ground may be an anchor plate 107 with at least one aperture 111 through which an anchoring member may be placed as additionally shown in FIG. 3. Either the stake 106 and the vertically extending arm 104 combination, or the anchor plate 107 with an anchoring member, attach the bracket to the ground to prevent it from moving with respect to the concrete forms, as described below.

Figure 2:
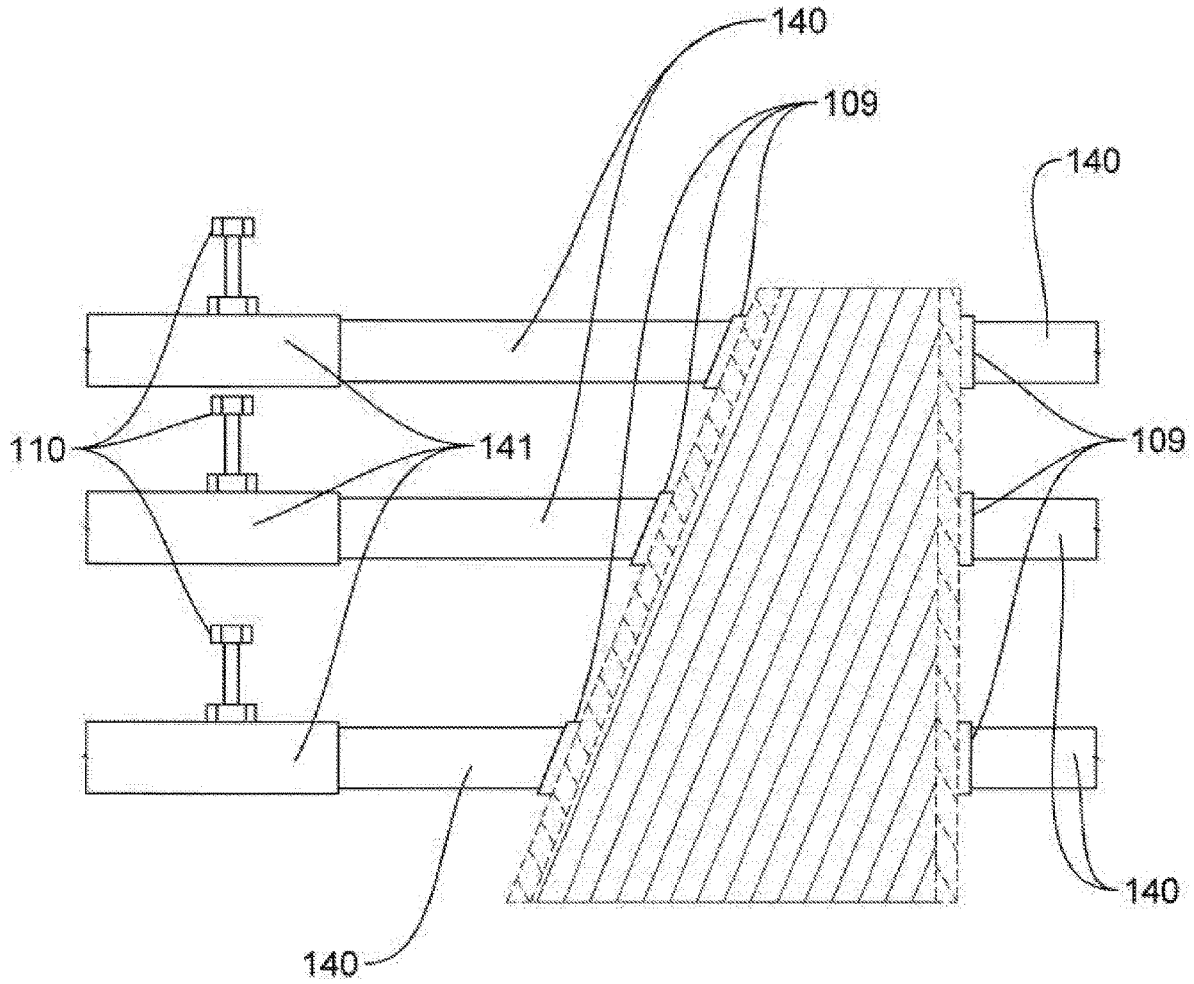
FIG. 2 is a partial cross-sectional side view of brackets used to hold two concrete forms for a curb, one of which forms is slanted and the other of which is vertical.

FIG. 2 is a partial cross-sectional side view of brackets used to hold two concrete forms for a curb, one of which forms is slanted (on the left) and the other of which is vertical (on the right). Each of the extendable horizontal arms 103 of the brackets has an adjustable length that can be set by using a set screw 110 or other means for fixing the extent to which the distal end 140 extends into the near end 141. Because the concrete form engaging plates 109 at the distal ends pivot, their full surface area engages the concrete form and holds it in place better than prior art plates that do not pivot or swivel.

Figure 3:
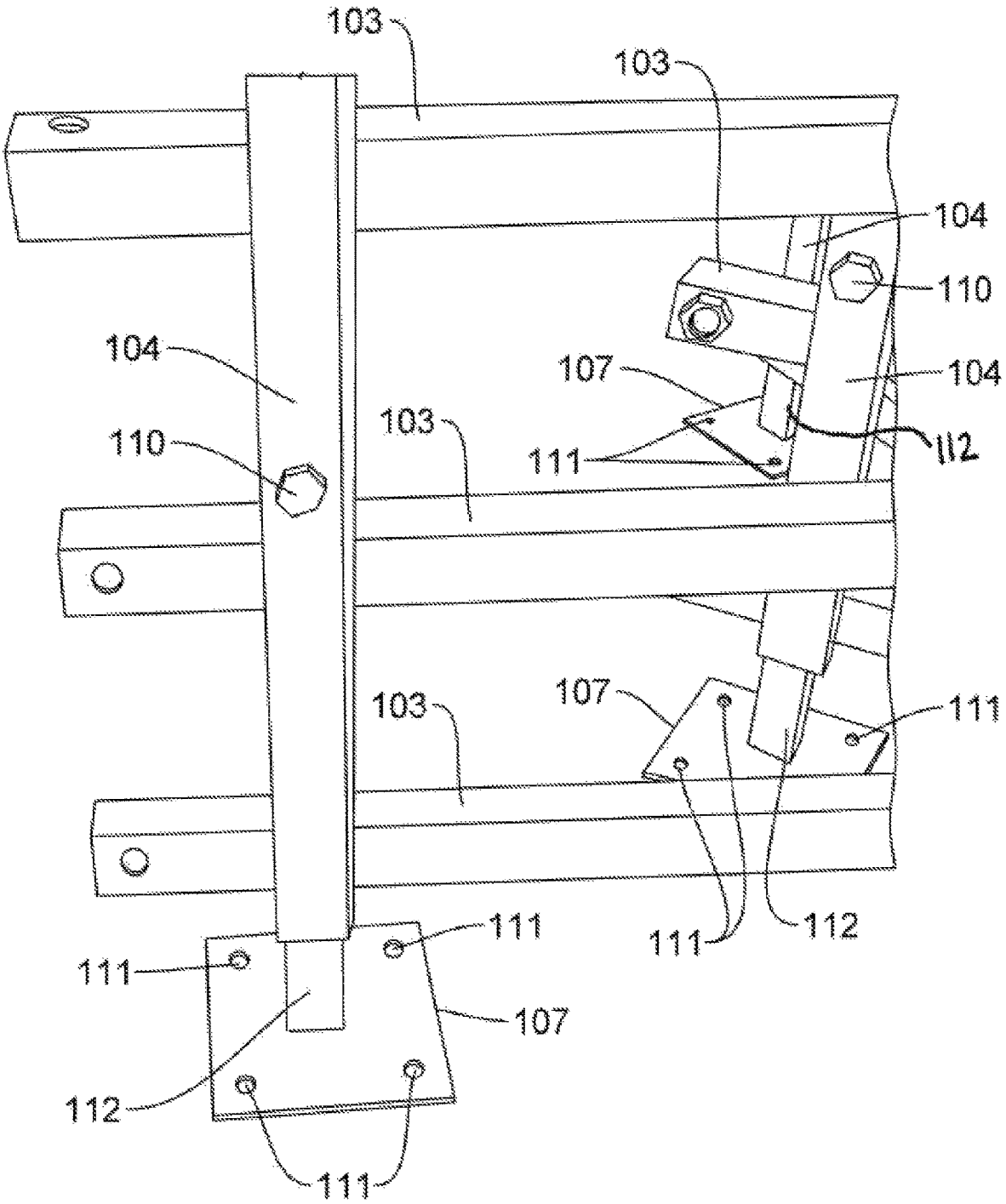
FIG. 3 is a partial perspective view of a bracket showing one of a plurality of sets of three horizontal arms, and three vertical arms.
Figure 4:
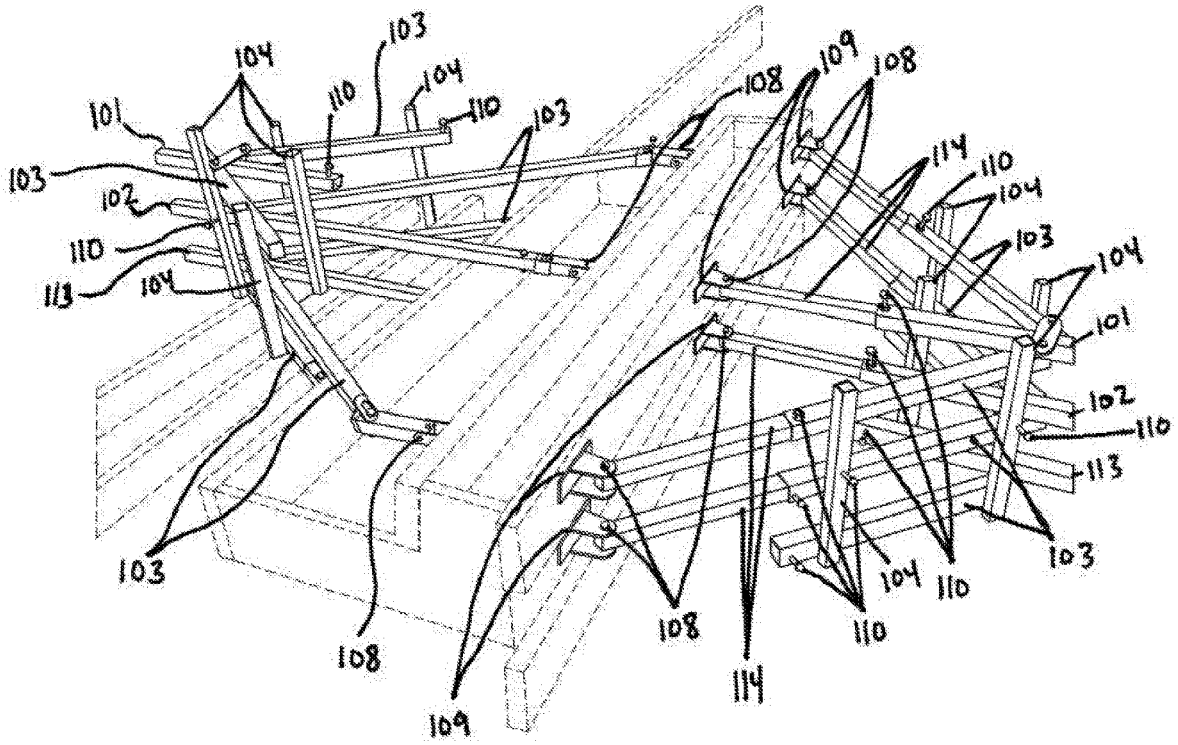
FIG. 4 shows two sets brackets, set up on opposite side of forms for pouring a curb.

FIG. 3 is a partial perspective view of a bracket showing one of a plurality of sets of three extendable horizontal arms 103 attached to a vertical arm 104. In this embodiment, the horizontal arms 103 are formed from 1.25" wide steel channel. The extendable part of the arms that telescope within the horizontal arms 114, as shown in FIG. 4, may be formed from 1.0" steel channel. In addition, the vertical arm 104 as shown is formed from a 1.25" wide steel channel upper portion. In this embodiment, a vertically extending arm 112 formed from 1.0"' steel channel telescopes within the hollow upper portion 104. A setscrew 110 or other means for fixing the extent to which the vertically extending arm 112 extends into the hollow upper portion 104 is provided. This is useful for applications in which the ground where the bracket is to be used is not level. The vertical arms 104 may be adjusted to keep the horizontal arms 103 closer to a perfectly horizontal position. In addition, if desired, the lower 1.0" steel channel of the vertically extending arm 112 may have at the bottom a ground engaging anchor plate 107 with holes 111. In one embodiment, 0.25" tapcon screws about 2.75" long may be inserted through such holes 111 into the ground or hard surface to secure the bracket.

FIG. 4 shows two sets of brackets, set up on opposite sides of a form for pouring a curb. This view shows how the brackets can provide support for a wide horizontal distance of forms for pouring concrete. FIG. 4 also shows how each individual horizontally extending arm 103 can be individually adjusted and set to a specific length.

One issue with concrete forms is that when concrete is poured, the weight of the concrete can cause the forms to bend or bulge outward, resulting in an irregular surface. The problem is greater the higher or thicker the concrete is poured due to the weight of the concrete. The same problem can also occur if a vibrator is applied to the concrete surface before the concrete fully sets.

Figure 5:
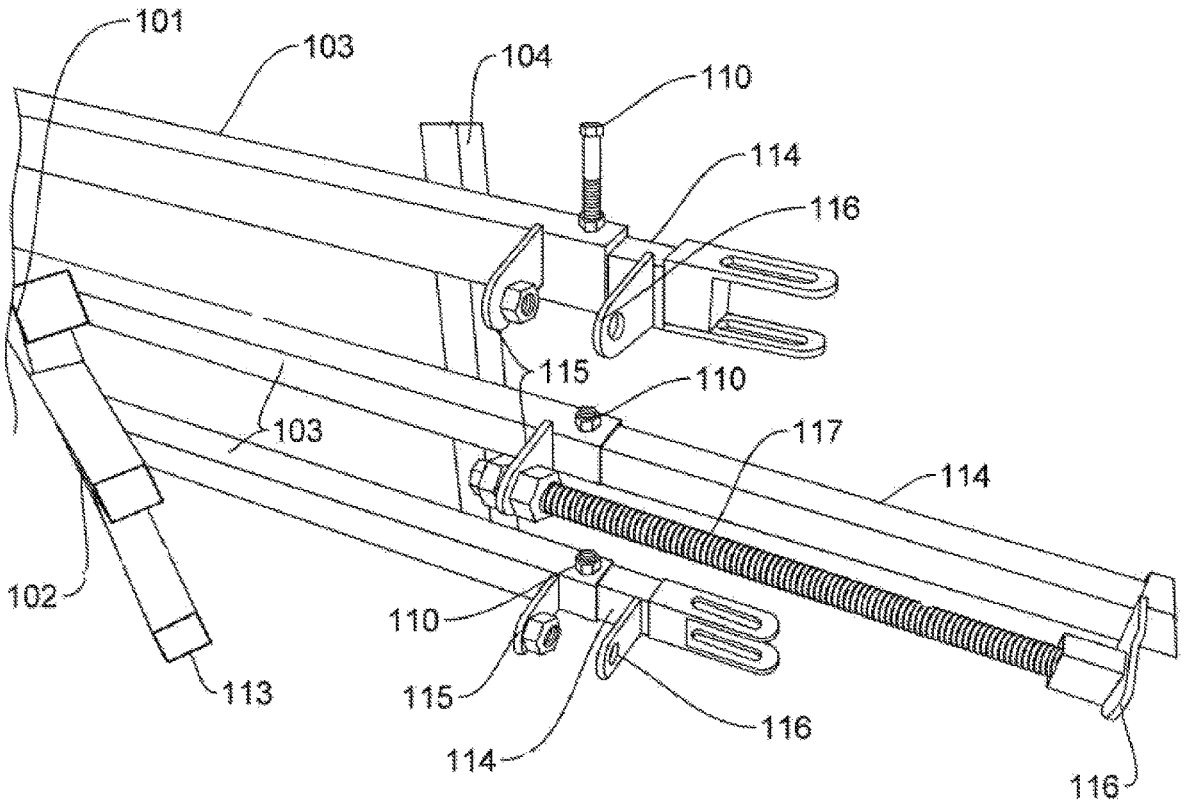
FIG. 5 shows a horizontal arm with ears containing a nut suitable to receive a coil rod on both its near and distal portions with a coil rod between the ears.
Figure 6:
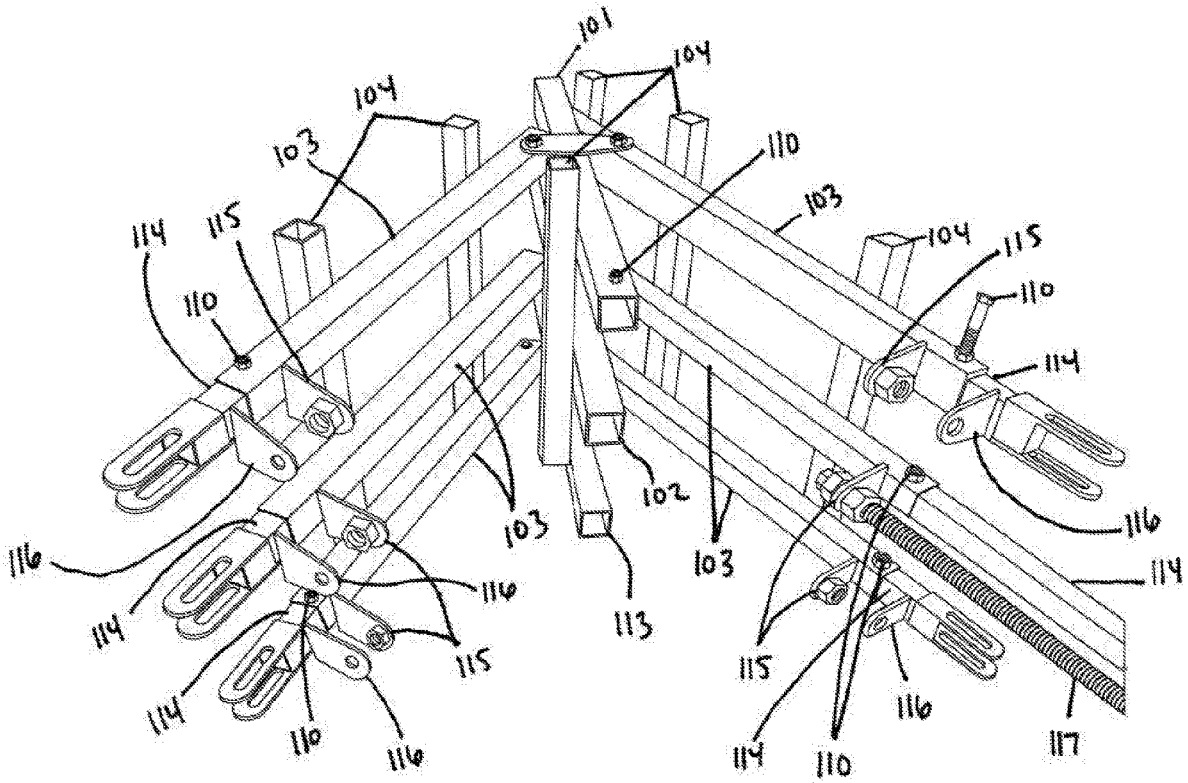
FIG. 6 is a perspective view of a bracket with two pivotable sets of arms that includes the ears and a coil rod as shown in FIG. 5.

FIGS. 5 and 6 show an embodiment that provides additional pressure to a form. For example, an extendable horizontal arm 103 may be provided with a set of ears 115, 116, the first ear with a nut 115 on the extendable horizontal arm 103 and the second ear 116 on the telescoping portion 114 of the arm. The nut on the first ear 115 is suitable to receive a coil rod 117. Once the distal end of the arm 114 is adjusted to abut a concrete form and the set screw 110 is tightened, the coil rod 117 may be threaded through the second ear 116 to engage the nut on the first ear 115. This transfers some of the load for holding the distal end of the arm 114 within the near portion of the arm 103 from the set screw 110 to the ears 115, 116 and coil rod 117. This configuration may be used on any of the telescoping arms 103, 114.

Figure 7:
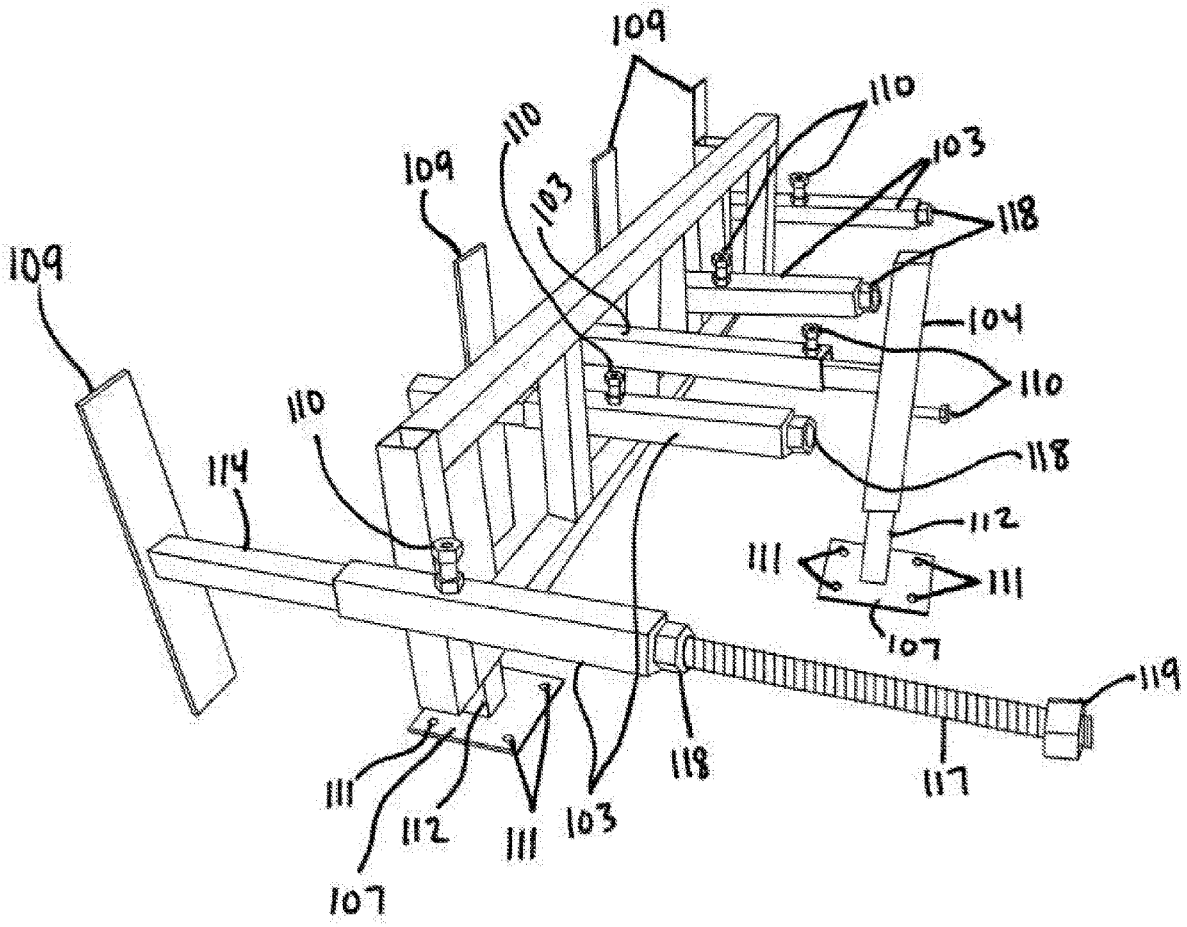
FIG. 7 shows a version of a bracket fit with a nut on each of the extendable arms to receive a coil rod to provide additional support for the form.

FIG. 7 shows an alternate embodiment for providing additional pressure to the forms. In this embodiment, the near end of the horizontal arms 103 of the brackets (i.e., the ends opposite the distal ends 114 that engage the concrete forms) may be provided with a nut 118, such as a 1.25" nut. The nut may receive a 1.0" diameter coil rod 117, which passes through the interior of the arm 103. The coil rod 117 may also have a nut 119 welded to the end to facilitate turning of the coil rod 117. As the coil rod 117 is threaded toward the concrete form, it engages the telescoping portion of the arm 114 that contains the concrete form engaging surface 109 and applies additional force to it to prevent the form from bulging outward. The coil rod 117 does not interfere with the tightening of set screw 110, as set screw 110 engages the distal end 114. The distal end 114 is hollow and of a sufficient interior dimension to allow coil rod 117 to pass through it.

Figure 8:
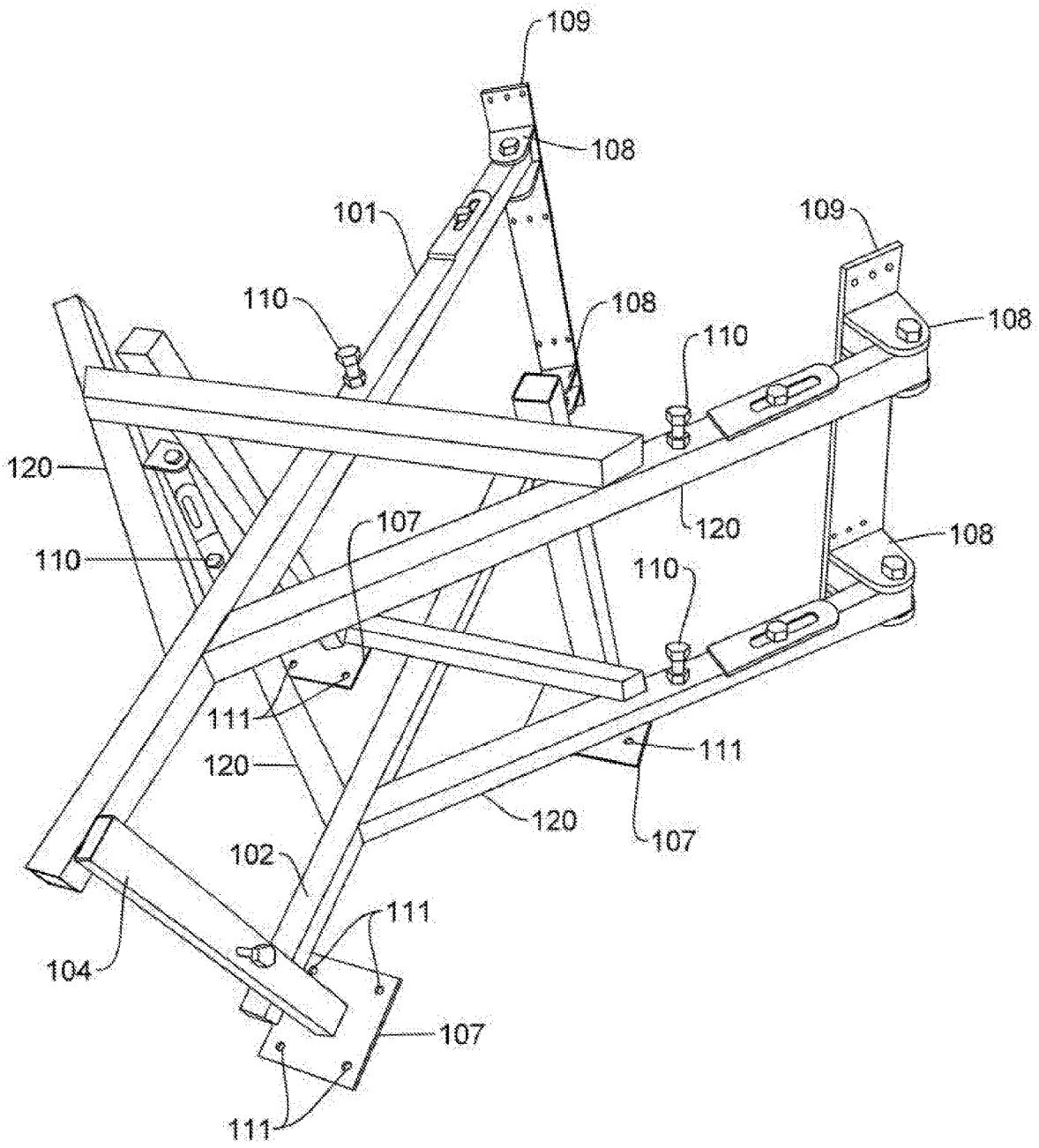
FIG. 8 shows a version of a bracket in which the two outer horizontal arms are welded to the bracket instead of being pivotably attached.

FIG. 8 shows a version of a bracket in which the horizontal arms 120 are welded to the bracket instead of being pivotably attached. This set up provides more rigidity. Though it does not allow the horizontal arms 120 to fold into a more compact set up (as shown in FIG. 1), this embodiment may be desired with extremely heavy concrete forms. This embodiment is also desired over the prior art due to the pivotable 108 concrete form engaging surfaces 109.

Figure 9A:
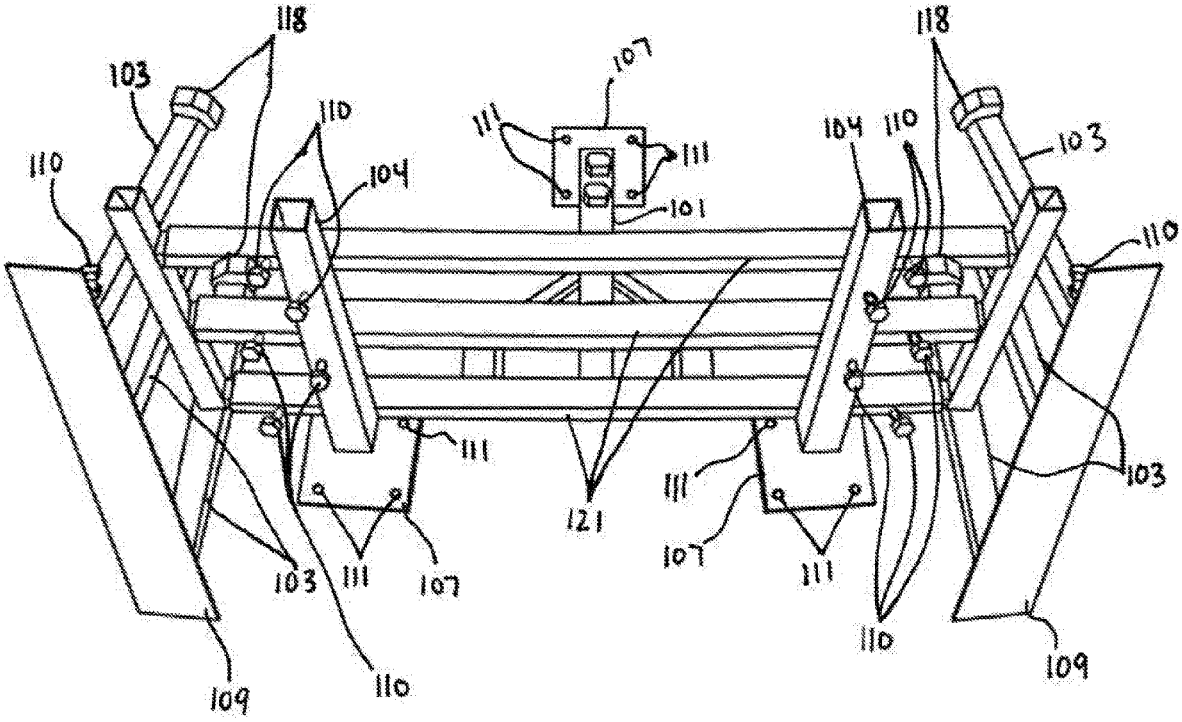
FIGS. 9A-9C show three versions of a bracket in which there can be a plurality of extendable arms attached and in which adding horizontal brackets can allow for taller extendable arms to be utilized.
Figure 9B:
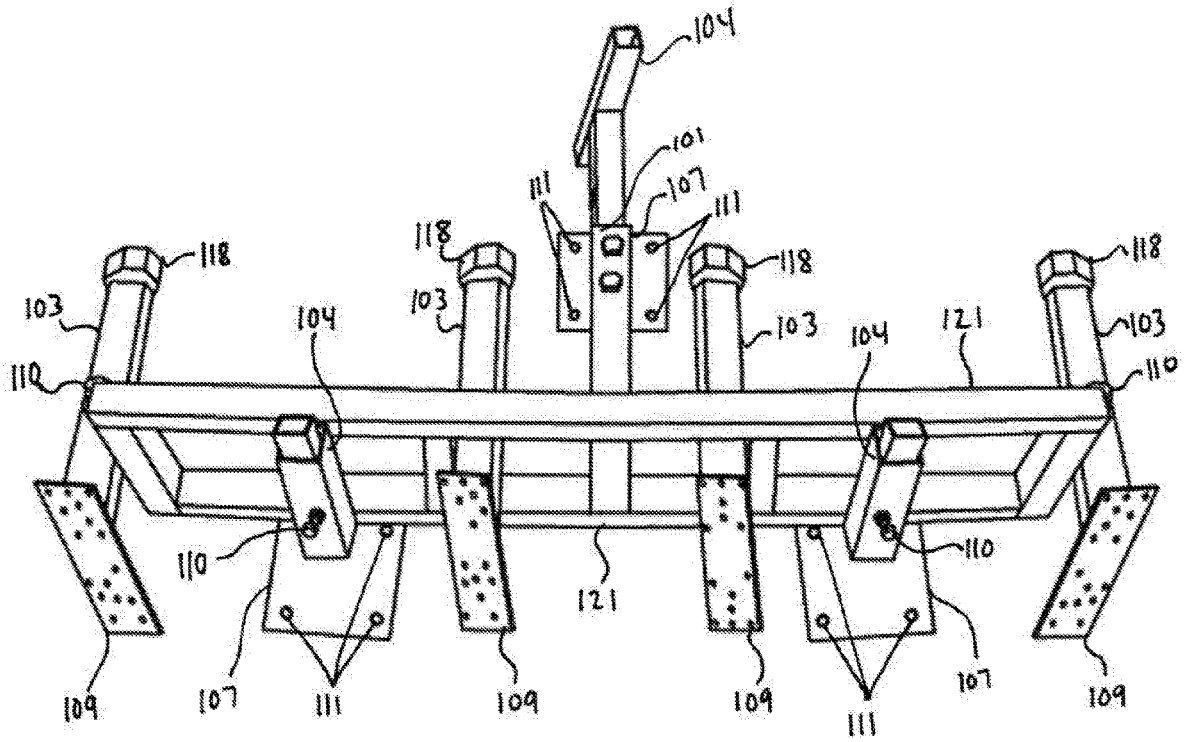
Figure 9C:
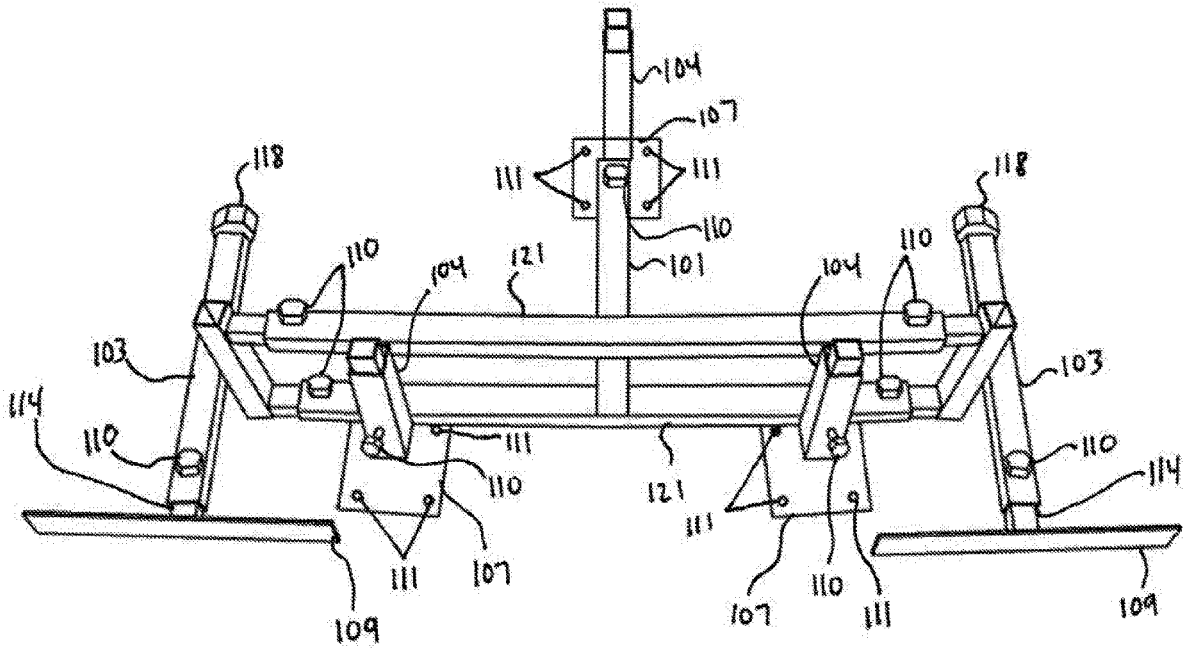

FIGS. 9A-9C show three versions of a bracket in which there can be a plurality of extendable arms 103 attached and in which adding central horizontal arms 121 can allow for taller extendable arms to be utilized. In FIG. 9A, there are three central horizontal arms 121 on each side of the bracket that allow for the use of two long concrete form engaging surfaces 109. In FIG. 9B, there are two central horizontal arms 121 and four horizontal extendable arms 103. In FIG. 9C, there are two central horizontal arms 121 and two horizontal extendable arms 103. These show how versatile the brackets are and how they can be used with a large variety of concrete forms.

FIG. 10 shows a version of the bracket with rubber caps 122 on the stakes 106 used to affix the bracket to the ground. The rubber caps 122 are an OSHA required safety feature to prevent workers from being impaled if they fall on the stake. They further protects a worker's hand if they hold onto the cap 122 while hammering the stake into the ground.

Figure 11:
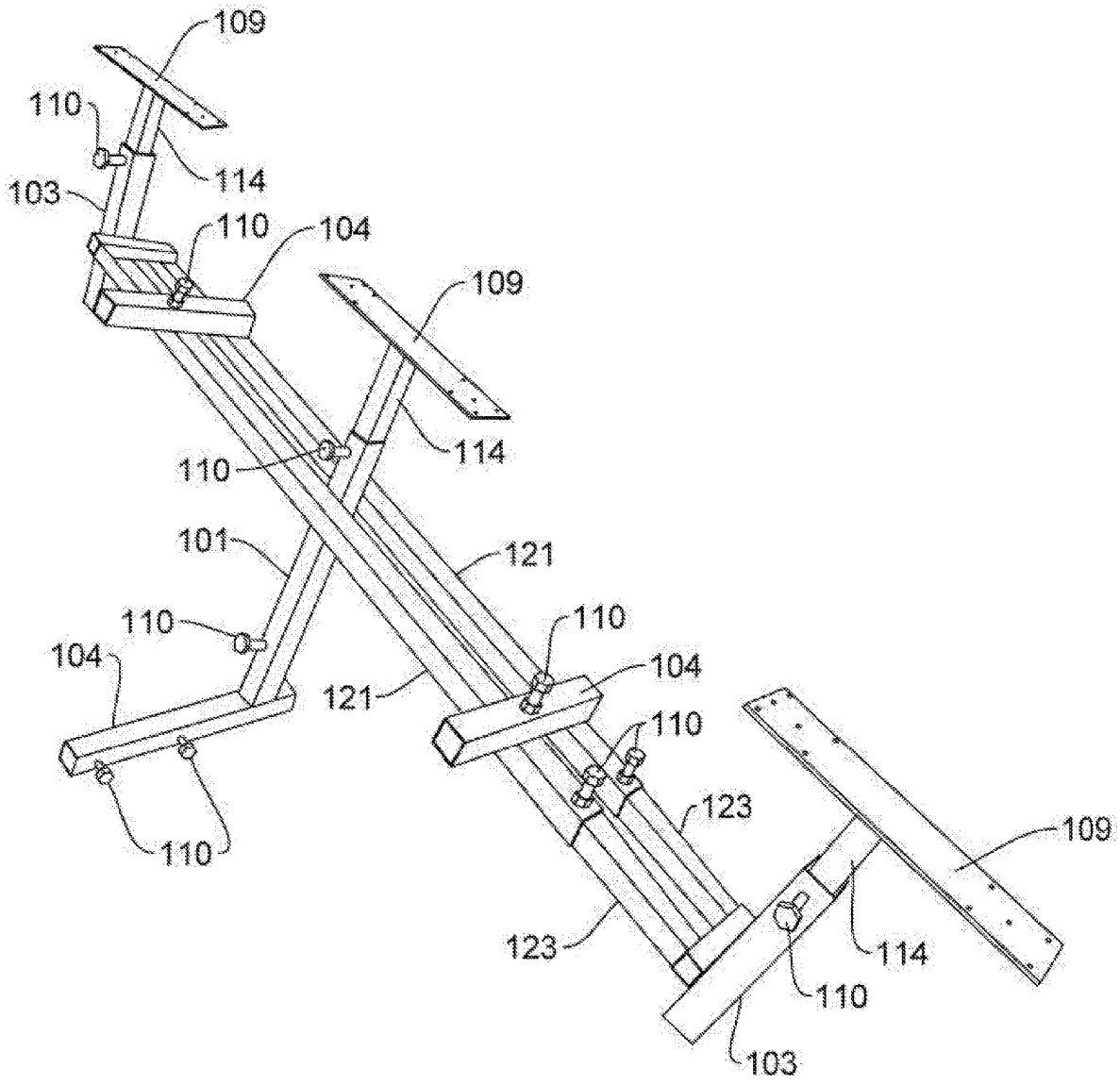
FIG. 11 shows a bracket with three extendable, non-pivotable, arms utilized to hold a form for a straight sidewalk.

FIG. 11 shows a bracket with three extendable, non-pivotable, arms 103 utilized to hold a form for a straight sidewalk. This is an improvement upon the prior art because instead of having to place a bracket with a single concrete form engaging surface every foot or two, one bracket can have multiple concrete form engaging surfaces that cover a wider or larger surface area. The bracket contains a central support arm 101 perpendicular to the two central horizontal arms 121. The two central horizontal arms 121 contain telescoping portions 123 that allow the distance between the concrete form engaging surfaces to be adjusted. The central support arm 101 holds a first concrete form engaging surface 109, while the two outer horizontal arms 103 hold a second and third concrete form engaging surface 109, respectively.

Figure 12:
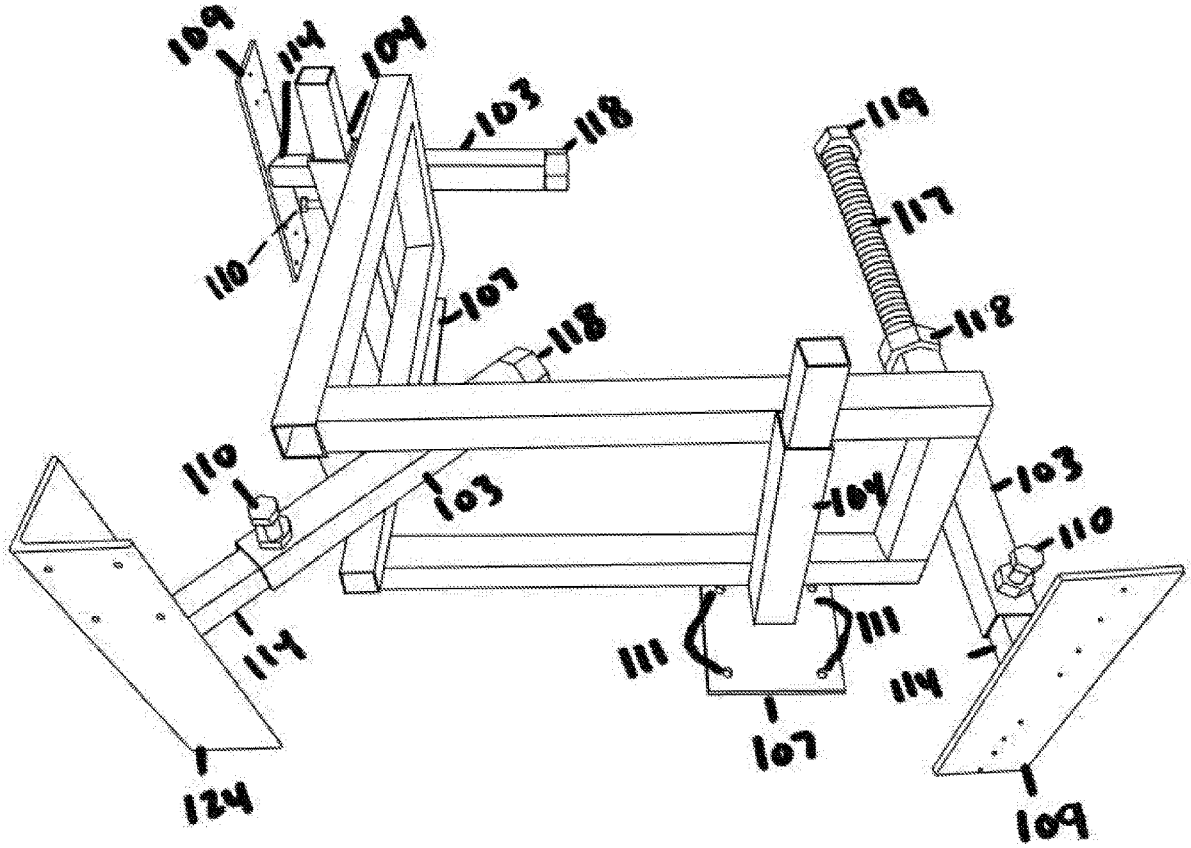
FIG. 12 shows a bracket with three extendable arms, all of which are fitted with a nut on one end that can receive a coil rod, and one of the extendable arms is designed to hold forms forming a ninety-degree angle.

FIG. 12 shows a bracket with three extendable horizontal arms 103, all of which are fitted with a nut 118 on one end that can receive a coil rod 117. The use of the nut 118 and coil rod 117 helps to alleviate some of the pressure from the concrete form. One of the concrete form engaging surfaces 124 in this version is designed to fit into a space with a ninety-degree angle, such as a corner of a form. The other two extendable arms 103 are situated at a ninety-degree angle from the extendable arm 103 with the corner concrete form engaging surface 124.

Figure 13:
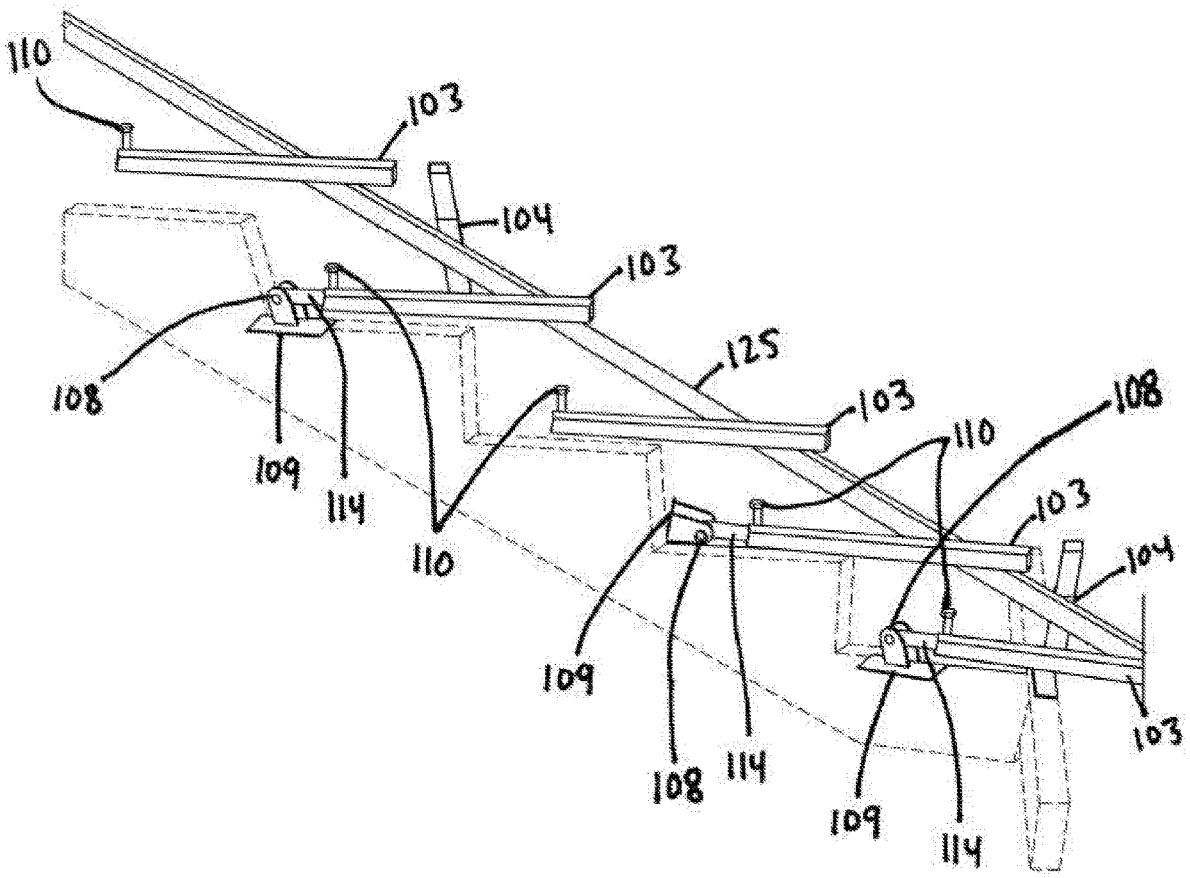
FIG. 13 shows a bracket three extendable arms, each extendable arm extending at an angle to hold forms to create stairs.

FIG. 13 shows a bracket with five extendable arms 103 welded to a central arm 125. Each extendable arm 103 is fitted with a rotatable end piece 108 that can be rotated to allow the concrete engaging surface 109 to abut a form. The bracket shown in FIG. 13 is one in which concrete would be poured to create stairs. Being able to extend the horizontal arms 103 and rotate the concrete form engaging surfaces 109 allows the user to apply pressure using the bracket on both horizontal and vertical surfaces of the forms.

Figure 14:
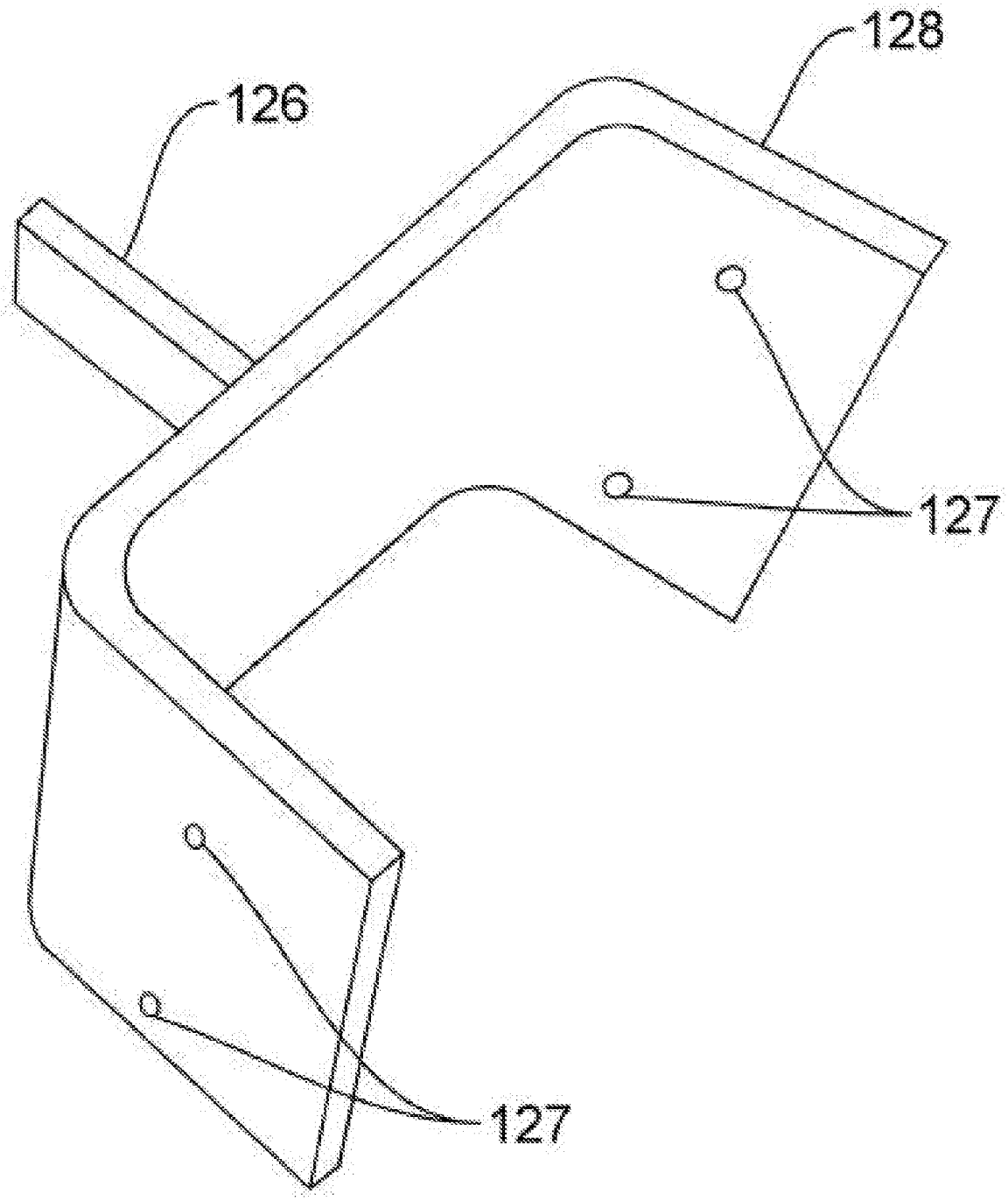
FIG. 14 shows a pocket bracket used to attach 2×4s to Symons panels to allow the use of quick curb brackets without screwing the quick curb brackets into the Symons panels.
Figure 15:
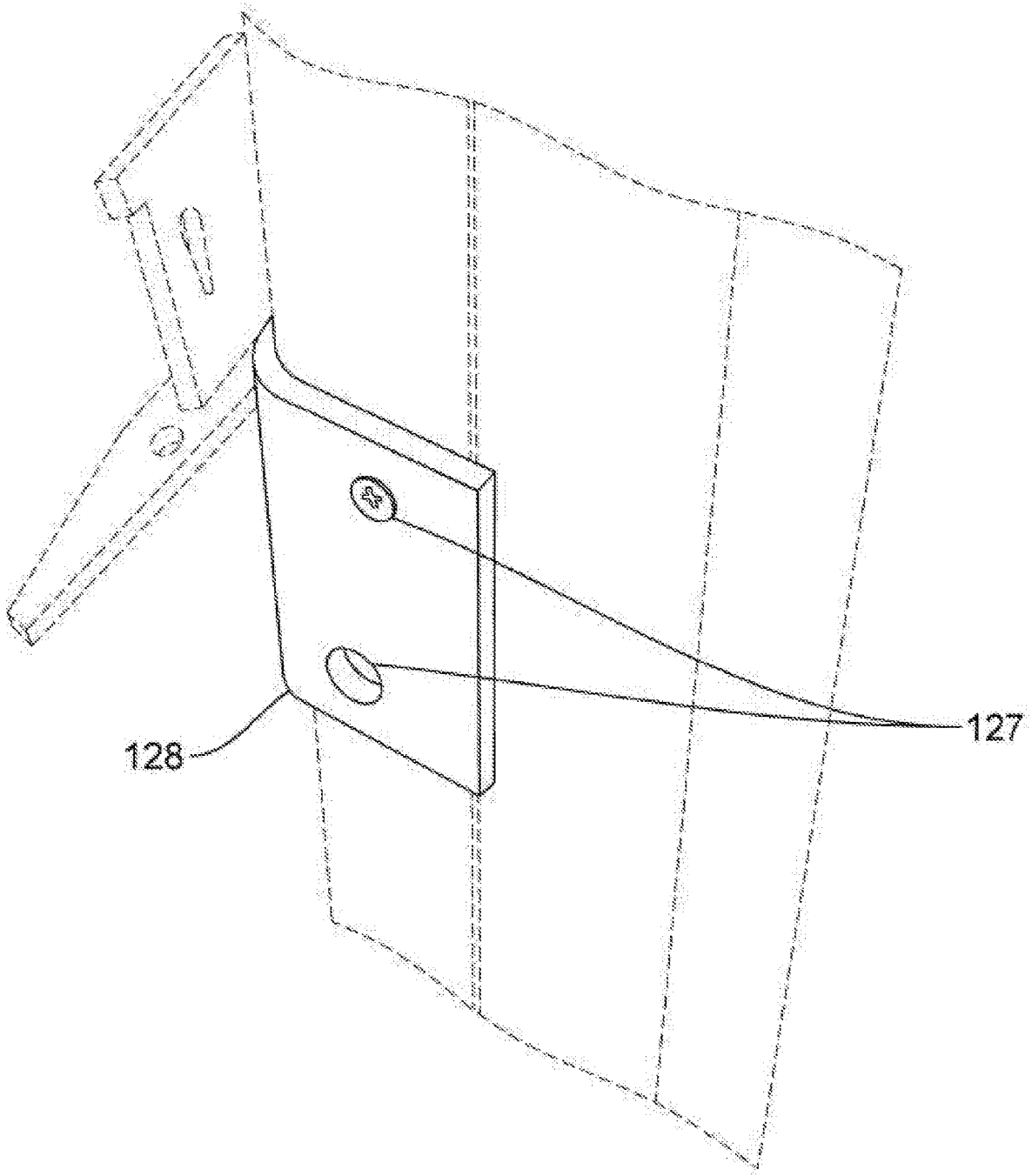
FIG. 15 shows a pocket bracket placed in the joint of a Symons panel and screwed to a 2×4 to allow the use of a quick curb bracket to hold the Symons panel in place without screwing the 2×4 to the Symons panel.

FIG. 14 shows a u-shaped pocket bracket 128 used to attach a 2×4 to Symons panels to allow the use of quick curb brackets without screwing them into the Symons panel. The metal tab 126 on the pocket bracket 128 is placed in the joint of a Symons panel as shown in FIG. 15. The pocket bracket 128 is then screwed to a 2×4 using the holes 127 in the bracket 128 to allow the use of a quick curb bracket to hold the Symons panel in place without screwing into the Symons panel.

Figure 16:
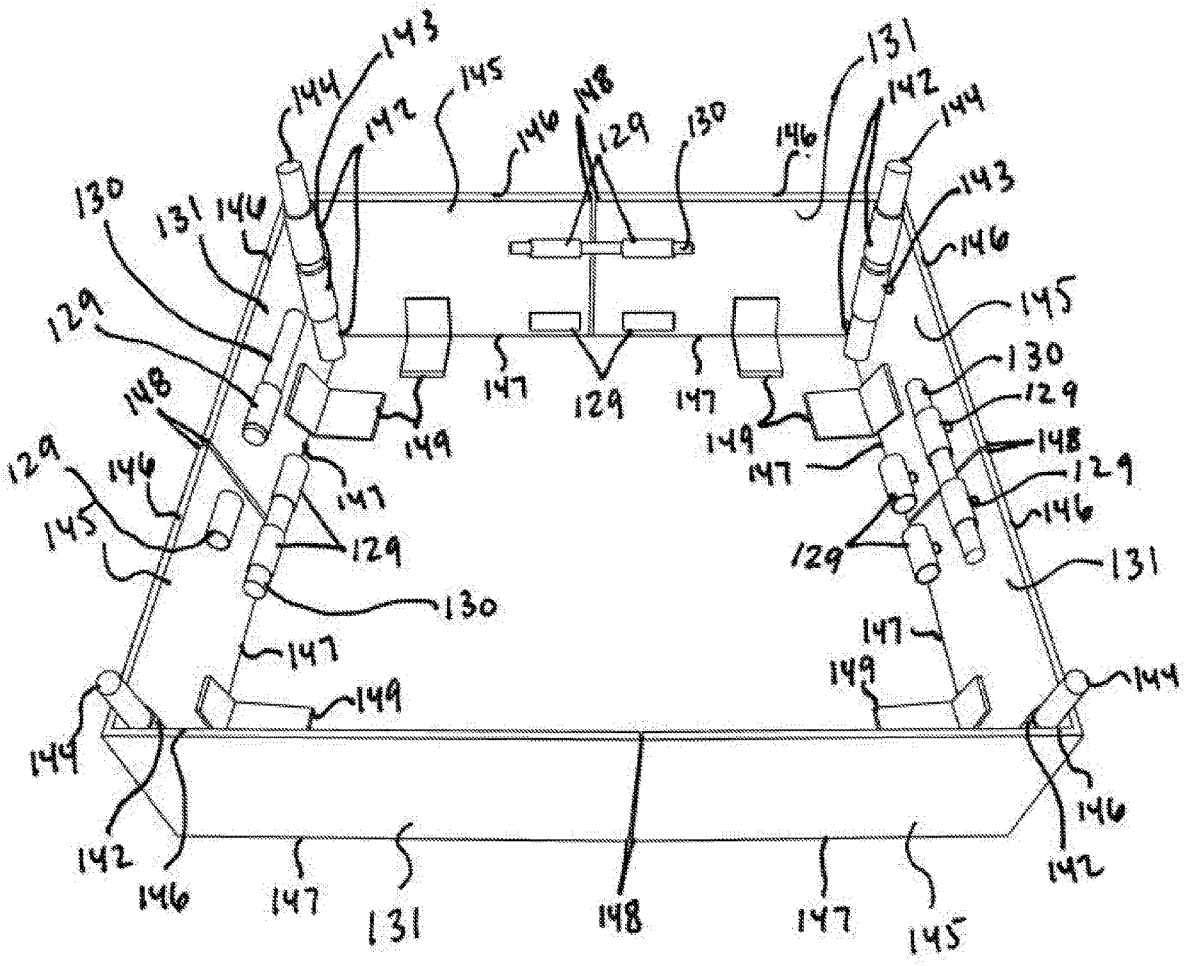
FIG. 16 shows a perspective view of an isolation form for a concrete slab with sliding connectors.

FIG. 16 shows an isolation form for a concrete slab with sliding connectors. When pouring concrete, there are times in which it is ideal to be able to leave an empty space that is not filled. The isolation form as shown in FIG. 16 allows this by placing the isolation form where a contractor does not want the concrete to be poured. The isolation form is comprised of multiple side pieces 131. To use the isolation form, a user will use a means to connect the different sides of the form. For example, a user could use a sliding mechanism, a latching mechanism, or a hinge mechanism.

The isolation form shown in FIG. 16 is comprised of eight side pieces 131, 145. Each side piece 131, 145 has a top edge 146, a bottom edge 147, and two side edges 148. On four of the side pieces 131, there are two vertical hollow tubular members 142, welded vertically on the edge of the piece such that there is a space intermediate the vertical tubular members 142 in which a vertical tubular member 143 welded to the other side pieces 145 may fit between them. The vertical tubular members 142, 143 line up such that a stake 144 may fit through them creating a sealed corner. Each side piece 131, 145 also contains two horizontal hollow tubular members 129 welded near the edge of the side piece 131, 145 opposite the vertical hollow tubular members 142, 143. The horizontal hollow tubular members 129 are welded in such a coaxial manner that the user can slide a rod 130 through each set of horizontal hollow tubular members 129 to seal the sides of the isolation form. Finally, each side piece 131, 145 has an l-shaped bracket welded co-planar with the bottom edge 147 of the side piece 131, 145 to keep the isolation form vertical.

Figure 17:
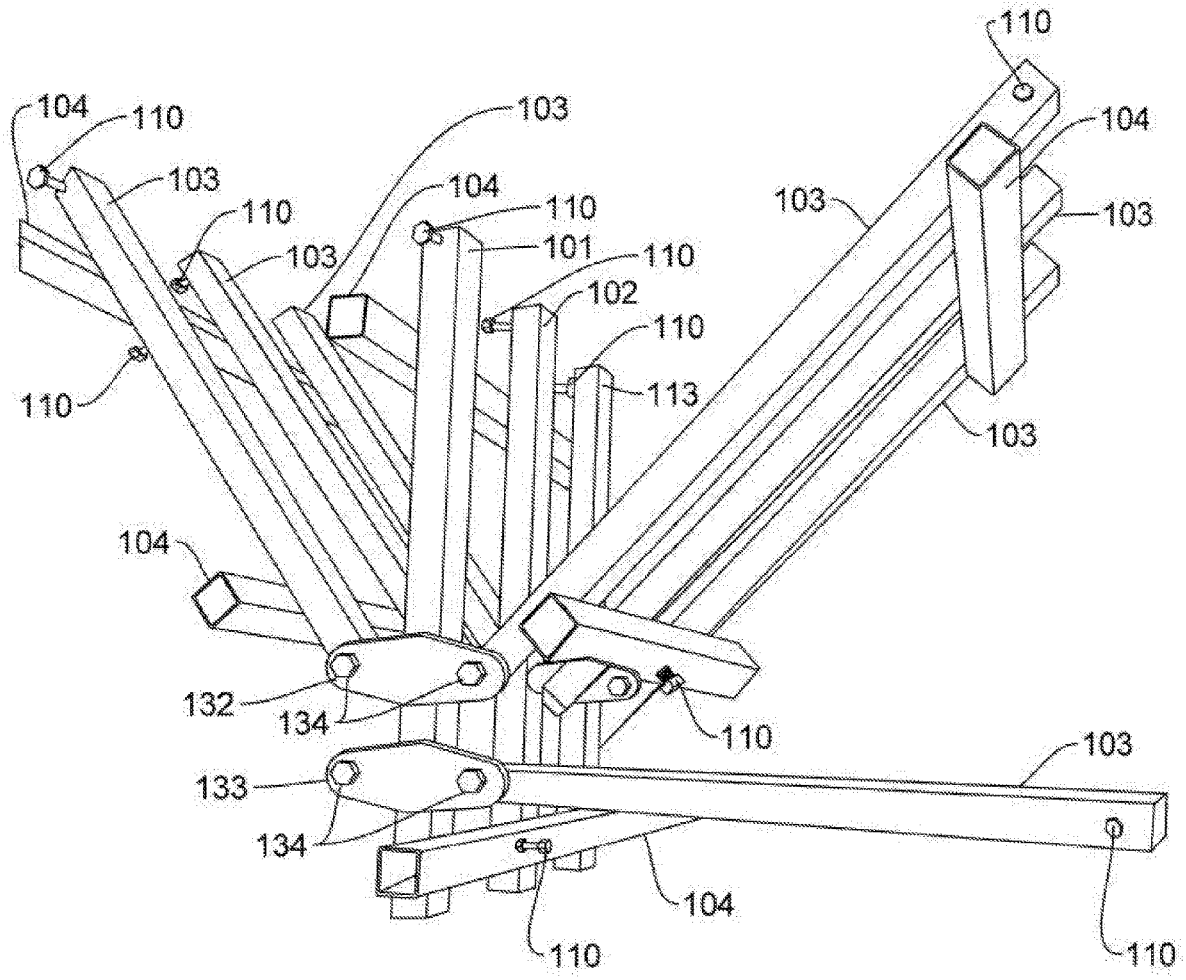
FIG. 17 shows a horizontal bracket with two sets of attachment points, each of which may hold two additional horizontal arms.

FIG. 17 shows a horizontal bracket with two sets of upper flanges 132, 133, each of which may hold two horizontal arms 103. This allows the use of five extendable arms 103 at once. One way of configuring five extendable arms 103 to one bracket includes providing a central arm 101 with two sets of flanges 132, 133. The upper flanges 132, 133 have holes that receive a bolt 134. Pivotable arms 103 may be attached to each bolt 134 of each upper flange 132, 133 to permit the arms to pivot about the bolt 134. FIG. 17 shows a bracket with a central arm 101 with two sets of flanges 132, 133 and three sets of horizontal arms 103. Thus, the rearmost flange 133 may receive the outermost pivotable arms 103. A fourth pivotable arm (not shown) may attach to the rearmost flange 133 using a bold 134 on the left side to provide a bracket having five arms.

Those of skill in the art will understand that various details of the invention may be changed without departing from the spirit and scope of the invention. Furthermore, the foregoing description is for illustration only, and not for the purpose of limitation, the invention being defined by the claims.

For example, in the above-described embodiments, the pivoting of the concrete form engaging surfaces is accomplished by one or two hinged connection in the distal end of each arm. Any other method of allowing pivoting may be employed, such as by using one or more ball-and-socket joints.

Also, in the above-described embodiments, the extendibility of the arms is provided by each arm having near and distal portions, and in which the distal portions telescopes from the near end. Alternate embodiments are envisioned. For example, the distal portion of an arm could have a larger cross-section, so that the near portion fits within the distal portion instead of vice-versa. Alternately, the extendibility of an arm could be accomplished by, for example, a hydraulic piston intermediate the concrete form engaging plate and the pivot point.

In addition, where the arms shown above have a square or rectangular cross section, other cross sectional shapes, such as a circular cross section are within the scope of the invention.

All references cited in this specification are incorporated herein by reference to the extent that they supplement, explain, provide a background for or teach methodology or techniques employed herein.

What is claimed is:

1. A concrete form support bracket comprising:

A vertically extending arm having at least one ground engaging surface and means for affixing the support bracket to the ground;

A plurality of horizontally extending arms, each such arm have a distal end comprising a concrete form engaging surface, and wherein:

at least one of the horizontally extending arms is horizontally pivotable with respect to the vertically extending arm;

at least one of the horizontally extending arms has a length that is adjustable and includes a means for fixing the length of the arm.

2. The concrete form support bracket of claim 1 wherein: the means for affixing the vertically extending arm to the ground comprises an interior hollow channel within the vertically extending arm, said channel being capable of receiving a stake.

3. The concrete form support bracket of claim 1 wherein: the means for affixing the support bracket to the ground comprises an anchoring plate fixedly connected to the at least one ground engaging surface of the vertically extending arm, said anchoring plate having at least one aperture through which an anchoring member may be extended to affix the vertically extending arm to the ground.

4. The concrete form support bracket of claim 1 wherein: the concrete form engaging surface of each horizontally extending arm is pivotable with respect to the vertically extending arm.

5. The concrete form support bracket of claim 1 wherein: each horizontally extending arm that is adjustable comprises:

a first near portion having an interior channel and a second distal portion that telescopes within the first near portion;

and wherein the means for fixing the length of the arm comprises a setscrew extending through the first near portion that engages the second distal portion to thereby affix the position of the second portion with respect to the first portion.

6. The concrete form support bracket of claim 1 wherein: the vertically extending arm comprises:

a hollow upper portion and a lower portion that telescopes within the hollow upper portion;

a means for fixing the extent to which the lower portion extends into the hollow upper portion.

7. The concrete form support bracket of claim 6 wherein: the ground engaging surface of the vertically extending arm is at a lower end of the lower portion of the vertically extending arm.

8. The concrete form support bracket of claim 7 wherein: the ground engaging surface comprises an anchor plate having at least one hole therethrough.

9. A concrete form support bracket comprising:

A vertically extending arm having at least one ground engaging surface and means for affixing the support bracket to the ground;

A plurality of horizontally extending arms, each such arm have a distal end comprising a concrete form engaging surface, and wherein:

at least one of the horizontally extending arms is horizontally pivotable with respect to the vertically extending arm;

at least one of the horizontally extending arms has a length that is adjustable and includes a means for fixing the length of the arm;

at least one of the horizontally extending arms:

is attached to a second vertically extending arm having a means for affixing the second vertically extending arm to the ground.

10. The concrete form support bracket of claim 9 wherein the means for affixing the second vertically extending arm to the ground comprises a stake.

11. The concrete form support bracket of claim 9 wherein the means for affixing the second vertically extending arm to the ground comprises an anchor plate.

12. A concrete form support bracket comprising:

At least one vertically extending arm having at least one ground engaging surface and means for affixing the support bracket to the ground;

A plurality of horizontally extending arms, each such arm have a distal end comprising a concrete form engaging surface, and wherein:

at least one of the horizontally extending arms is horizontally pivotable with respect to the vertically extending arm;

at least one of the horizontally extending arms has a length that is adjustable and includes a means for fixing the length of the arm;

A central arm having first and second flanges and wherein:

the first flange attaches a first and second horizontally extending arm to the central arm.

13. The concrete form support bracket of claim 12 wherein:

the second flange attaches a third and fourth horizontally extending arm to the central arm.

14. The concrete form support bracket of claim 12 wherein:

the central arm has a length that is adjustable and includes a means for fixing the length of the arm.

* * * * *